US009637281B2

(12) United States Patent
Koo

(10) Patent No.: US 9,637,281 B2
(45) Date of Patent: May 2, 2017

(54) CONTAINER

(71) Applicants: THREEWAY TECHNOLOGY CO., LTD., Seoul (KR); Hong Sik Koo, Seoul (KR)

(72) Inventor: Hong Sik Koo, Seoul (KR)

(73) Assignees: THREEWAY TECHNOLOGY CO., LTD., Seoul (KR); Hong Sik Koo, Seoul (KR)

( * ) Notice: Subject to any disclaimer, the term of this patent is extended or adjusted under 35 U.S.C. 154(b) by 46 days.

(21) Appl. No.: 14/373,121

(22) PCT Filed: Jan. 18, 2013

(86) PCT No.: PCT/KR2013/000439

§ 371 (c)(1),
(2) Date: Jul. 18, 2014

(87) PCT Pub. No.: WO2013/109103

PCT Pub. Date: Jul. 25, 2013

(65) Prior Publication Data

US 2015/0014320 A1 Jan. 15, 2015

(30) Foreign Application Priority Data

Jan. 20, 2012 (KR) ..... 10-2012-0006675
Jan. 26, 2012 (KR) ..... 10-2012-0007987
Apr. 29, 2012 (KR) ..... 10-2012-0045019
Sep. 12, 2012 (KR) ..... 10-2012-0101267

(51) Int. Cl.
*B65D 43/12* (2006.01)
*B65D 45/20* (2006.01)
*B65D 53/02* (2006.01)
*B65D 43/02* (2006.01)

(52) U.S. Cl.
CPC ..... *B65D 45/20* (2013.01); *B65D 43/0214* (2013.01); *B65D 43/12* (2013.01); *B65D 53/02* (2013.01)

(58) Field of Classification Search
CPC .... B65D 45/20; B65D 53/02; B65D 43/0214; B65D 45/265; B65D 45/267; B65D 45/26; B65D 45/025; B65D 45/16; B65D 43/0222; B65D 43/12
USPC ..... 220/324, 326, 345.2, 345.3, 345.6, 351, 220/784–786, 788, 378, 795, 803, 806, 220/849, 841; 292/257, DIG. 11
See application file for complete search history.

(56) References Cited

U.S. PATENT DOCUMENTS 2,047,720 A * 7/1936 Wilhelm ..... 220/803
2,271,062 A * 1/1942 Courtney ..... 220/285
2,503,693 A * 4/1950 Van Lennep ..... 249/121
(Continued)

FOREIGN PATENT DOCUMENTS

JP 2000-289782 A 10/2000
KR 20-0404820 Y1 12/2005
(Continued)

*Primary Examiner* — James N Smalley
(74) *Attorney, Agent, or Firm* — Birch, Stewart, Kolasch & Birch, LLP

(57) ABSTRACT

A container is disclosed. The container includes a cover and a container body, a rotation member is rotatably coupled to the cover, and the rotation member pulls down the cover so as to be coupled to the container body when the rotation member is coupled to the container body.

16 Claims, 17 Drawing Sheets

(56) References Cited

U.S. PATENT DOCUMENTS

| | | | | |
|---|---|---|---|---|
| 2,689,059 | A * | 9/1954 | Nudell | 220/315 |
| 5,555,995 | A * | 9/1996 | Galer | 220/345.3 |
| 6,105,805 | A * | 8/2000 | Labelle et al. | 220/262 |
| 6,805,795 | B2 * | 10/2004 | Hawkins | B01D 35/30 210/238 |
| 2007/0095837 | A1 * | 5/2007 | Meier | 220/324 |

FOREIGN PATENT DOCUMENTS

| | | | |
|---|---|---|---|
| KR | 10-2007-0120007 | A | 12/2007 |
| KR | 20-2010-0007714 | U | 7/2010 |
| KR | 10-0973159 | B1 | 8/2010 |

* cited by examiner

-Prior Art-

Fig. 5
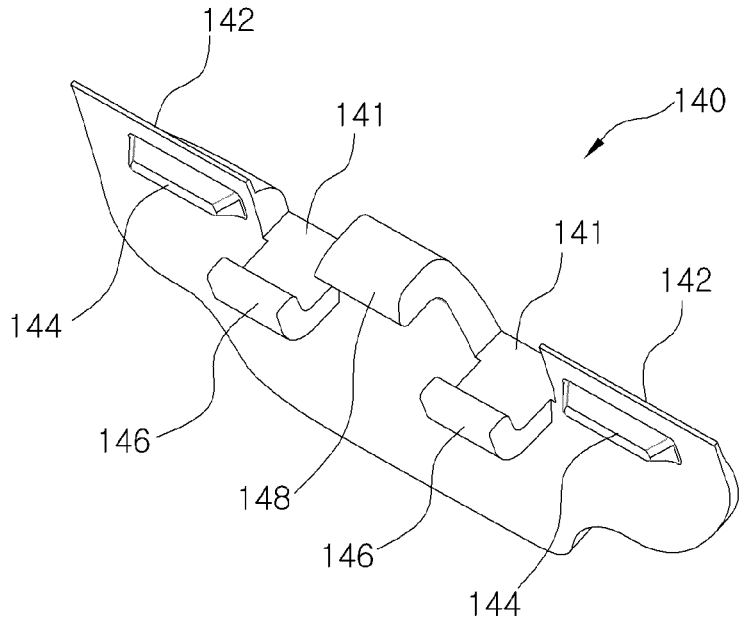
【Fig. 6】
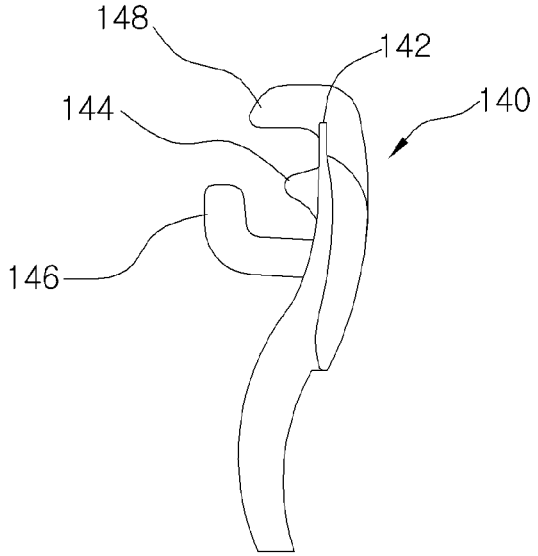

CONTAINER

TECHNICAL FIELD

The present invention relates to a container, and more particularly, to a container in which a cover can be easily coupled to and decoupled from a container body.

BACKGROUND ART

In recent years, containers have been used more and more to extend a storage period of food and to sanitarily store food. In the related art, as illustrated in FIG. 1, a container 10 includes a cover 12 and a container body 16, coupling wings 14 are disposed on the circumference of the cover 12, and a locking protrusion 18 to which four coupling wings 14 are locked is formed on the circumference of the container body 16. In order to couple the cover 12 to the container body 16 to completely seal the container body 16, the four coupling wings 14 have to be pulled down and be locked to the locking protrusion 18. In order to decouple the cover 12 from the container body 16, the four coupling wings 14 have to be pulled up and be decoupled from the locking protrusion 18.

In this way, since the coupling wings 14 have to be pulled down or pulled up in the course of coupling or decoupling the cover 12, the container 10 in the related art has a problem with inconvenient use. Particularly, when one coupling wing 14 out of the four coupling wings 14 is not locked in the course of decoupling or coupling the cover 12, there is a problem in that contents in the container body 16 flow out or air flows in the container body 16 to damage the contents.

In the container 10 of the related art, joints between the cover 12 and the coupling wings 14 are formed concave for smooth rotation of the coupling wings 14. There is a problem in that it is difficult to wash the cover 12 clean due to the concave joints between the cover 12 and the coupling wings 14. Particularly, the container 10 of the related art has a problem in that all the four coupling wings 14 have to be washed.

The container 10 of the related art includes a rubber packing 15 which is inserted into the cover 12. The rubber packing 15 serves to seal the space between the cover 12 and the container body 16 when both are coupled to each other. However, when the cover 12 is strongly coupled to the container body 16, a vacuum pressure is generated in the container body and it is not easy to decouple the cover 12. There is also a problem in that the packing of the container 10 of the related art is detached from the cover 12 in the course of decoupling the cover 12.

SUMMARY OF THE INVENTION

Technical Problem

Therefore, the present invention is made to solve the above-mentioned problems and an object thereof is to provide a container in which a cover can be easily coupled to and decoupled from a container body.

Another object of the invention is to provide a container that can prevent a packing from being detached in the course of decoupling a cover.

Other objects of the invention will become more apparent from the below-described embodiments.

Solution to Problem

According to an aspect of the invention, there is provided a container including a cover and a container body, wherein a rotation member is disposed on one side of the cover so as to be rotatable, and the rotation member pulls down the cover so as to be coupled to the container body when coupling the rotation member to the container body.

According to another aspect of the invention, there is provided a container including a cover and a container body, wherein a rotation member is disposed on one side of the cover so as to be rotatable, and the rotation member pushes up the cover so as to release the coupling to the container body when decoupling the rotation member from the container body.

The container according to the invention may include one or more of the following embodiments. For example, the cover may include a rear protrusion, and the rear protrusion may be coupled to or decoupled from the container body by rotation of the rotation member.

The cover may include a side protrusion, and the side protrusion may be coupled to or decoupled from the container body by rotation of the rotation member.

The container may further include a packing that is coupled to the cover and the packing may include an air groove so as to be closely attached to the cover.

The container may further include a packing that is coupled to the cover, the cover may include an air passage, the packing may include a packing protrusion protruding outward, the packing protrusion may be pressed by the rotation of the rotation member to close or open the air passage.

According to still another aspect of the invention, there is provided a container including a container body and a cover, wherein a packing is interposed between the container body and the cover, a rotation member that is coupled to the container body is coupled to the cover, an air passage is formed in at least one of the container body, the cover, and the packing, the air passage is closed when the rotation member is coupled to the container body, and the air passage is opened when the rotation member is decoupled from the container body.

According to still another aspect of the invention, there is provided a container including a container body, a cover that is coupled to the container body, and a packing that is coupled to the cover, wherein the packing includes an air groove formed concave in the upper part thereof, and the packing comes in close contact with the cover by the air groove when the cover is coupled to the container body.

Effects of the Invention

According to the aspects of the invention, it is possible to provide a container in which a cover can be easily coupled to and decoupled from a container body.

According to the aspects of the invention, it is possible to provide a container that can prevent a packing from being easily detached from a cover in the course of decoupling the cover.

BRIEF DESCRIPTION OF THE DRAWINGS

FIG. 5 is a perspective view illustrating a rotation member of the container illustrated in FIG. 2.

FIG. 6 is a side view of the rotation member illustrated in FIG. 5.

DESCRIPTION OF EMBODIMENTS OF THE INVENTION

Figure 1:
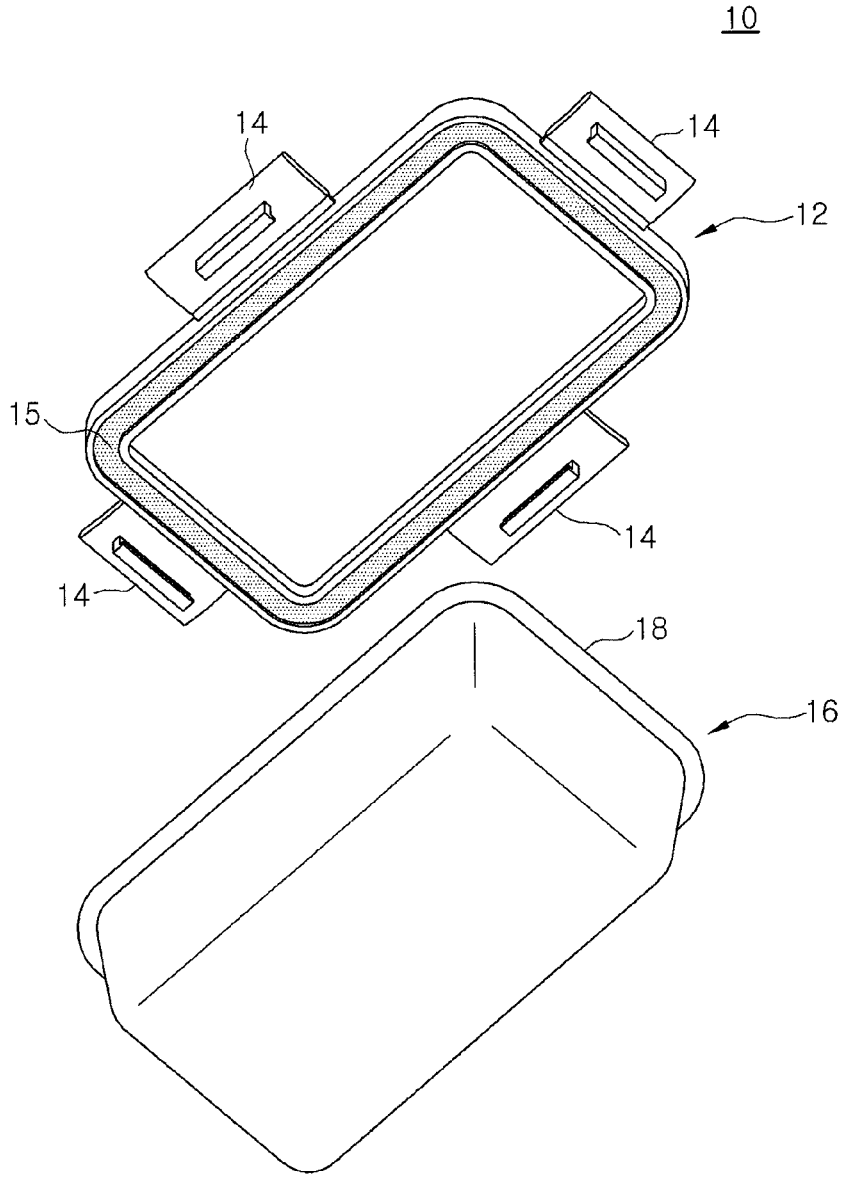
FIG. 1 is an exploded perspective view illustrating a container in the related art.

The invention can be modified in various forms and can have various embodiments. Specific embodiments will be illustrated in the drawings and described in detail. However, the embodiments are not intended to limit the invention, but it should be understood that the invention includes all modifications, equivalents, and replacements belonging to the concept and the technical scope of the invention. When it is determined that detailed description of known techniques involved in the invention makes the gist of the invention obscure, the detailed description thereof will not be made.

The terms used in the following description are intended to merely describe specific embodiments, but not intended to limit the invention. An expression of the singular number includes an expression of the plural number, so long as it is clearly read differently. The terms such as "include" and "have" are intended to indicate that features, numbers, steps, operations, elements, components, or combinations thereof used in the following description exist and it should thus be understood that the possibility of existence or addition of one or more other different features, numbers, steps, operations, elements, components, or combinations thereof is not excluded.

Terms such as one side, the other side, a rear side, and a side can be used to describe various elements, but the elements should not be limited to the terms. The terms is used only for distinguishing one element from another element.

A lateral direction, a one side direction, and the other side direction do not only the horizontal direction, but are concepts including oblique lateral directions having inclined angles.

A container according to the present invention can be used to store various objects such as food, cosmetics, and accessories.

Hereinafter, embodiments of the invention will be described in detail with reference to the accompanying drawings. In describing the invention with reference to the accompanying drawings, like elements are referenced by like reference numerals or signs regardless of the drawing numbers and description thereof is not repeated.

Figure 2:
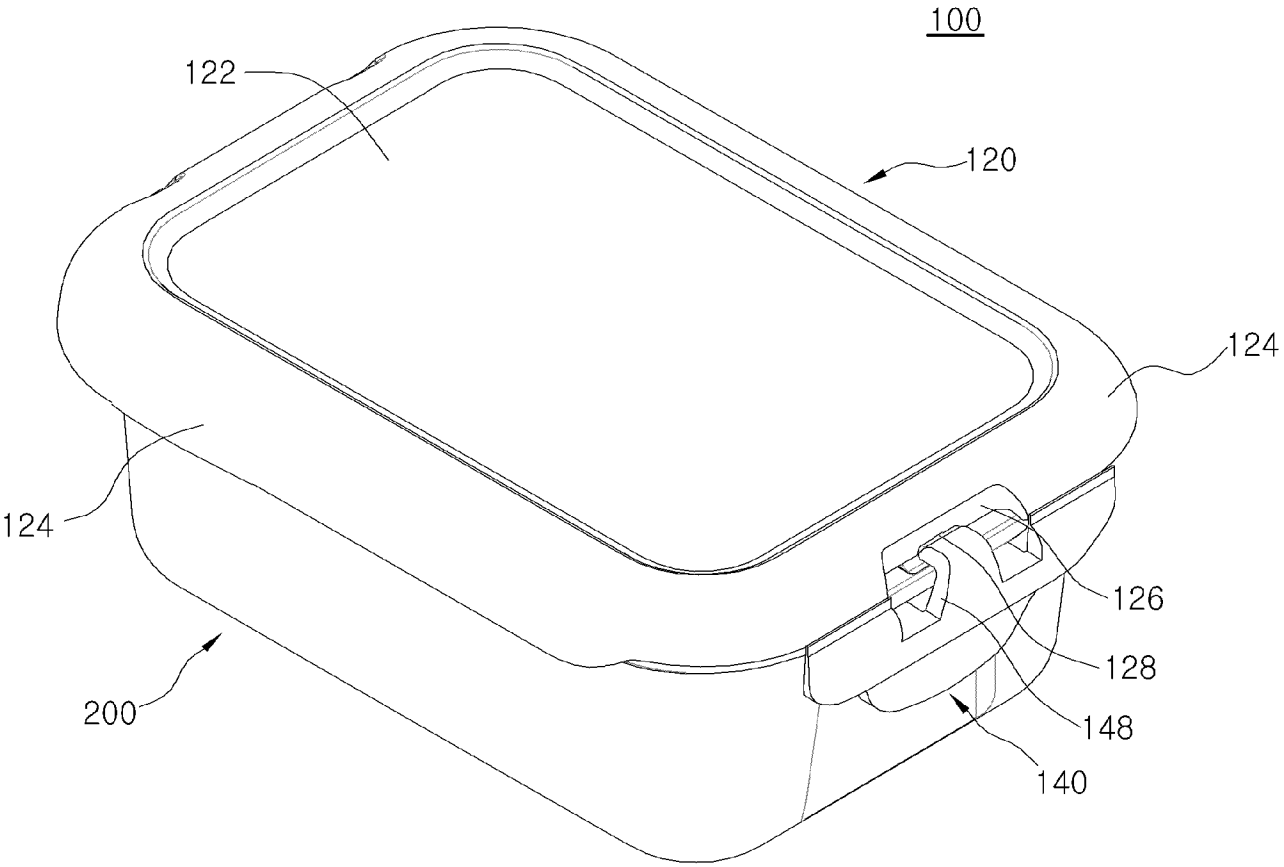
FIG. 2 is a perspective view illustrating a coupled state of a container according to an embodiment of the invention.
Figure 3:
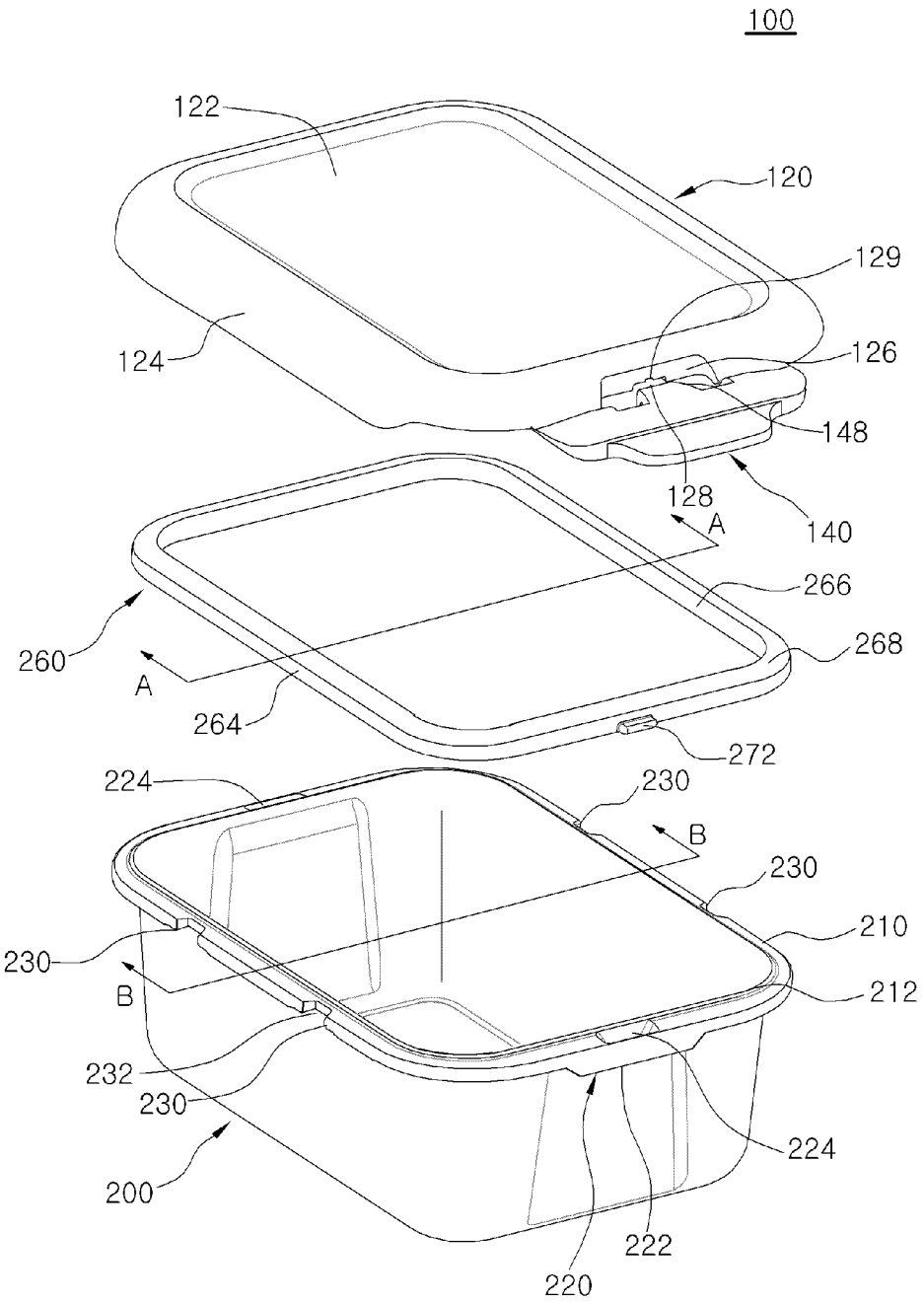
FIG. 3 is an exploded perspective view of the container illustrated in FIG. 2.

FIG. 2 is a perspective view illustrating a coupled state of a container 100 according to an embodiment of the invention and FIG. 3 is an exploded perspective view of the container 100 illustrated in FIG. 2.

The container 100 according to this embodiment has a rectangular shape of which corners are rounded, but may have various shapes such as a polygonal shape, an elliptical shape, or a circular shape.

Referring to FIG. 2, the container 100 according to this embodiment includes a cover 120, a container body 200, and a packing 260. The cover 120 includes a rotation member 140 for coupling to the container body 20 on the circumference thereof. The container 100 according to this embodiment can easily couple and decouple the cover 120 to and from the container body 20 by operating the single rotation member 140.

The packing 260 is coupled to the cover 120. When the cover 120 is coupled to the container body 200, the packing 260 is interposed between the cover 120 and the container body 20 to provide a sealing force. The packing 260 of the container according to this embodiment includes an air groove 268. The air groove 268 forms a vacuum pressure so as to prevent the packing 260 from being easily decoupled from the cover 120.

The cover 120 of the container 100 according to this embodiment will be described below with reference to FIGS. 2 to 4.

Figure 4:
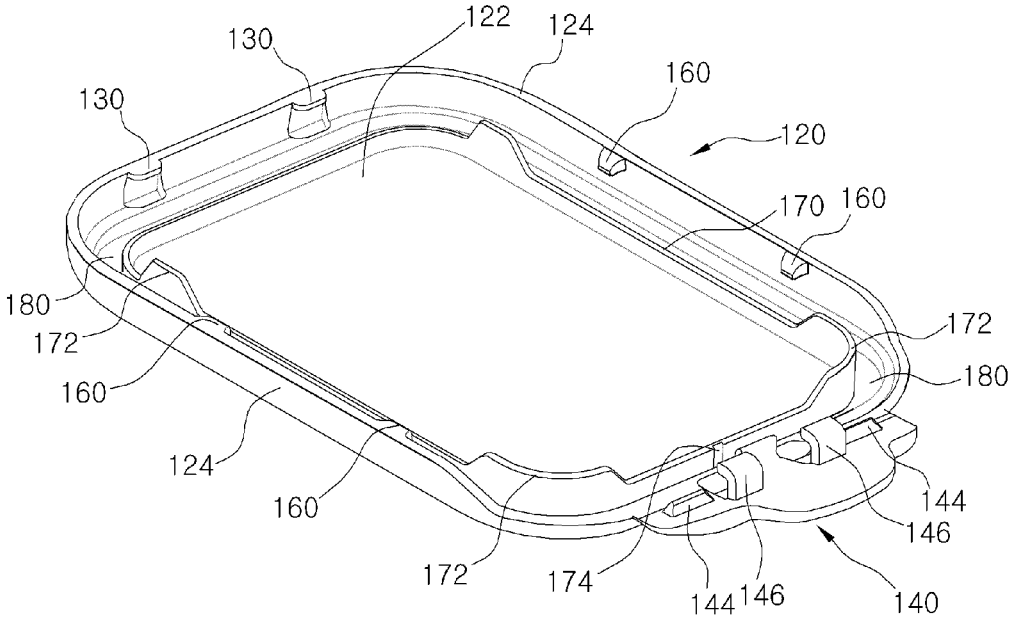
FIG. 4 is a perspective view illustrating a bottom surface of a cover of the container illustrated in FIG. 2.

FIG. 4 is a perspective view illustrating the bottom surface of the cover 120 of the container 100 illustrated in FIG. 2.

Referring to FIGS. 2 to 4, the cover 120 is coupled to the container body 200 to close the container body 200. A single rotation member 140 is rotatably coupled to a side surface of the cover 120. The cover 120 is coupled to the container body 200 while moving downward to a side in the course of locking the rotation member 140 to a rotation locking portion 220 of the container body 200.

The cover 120 includes a cover body 122, an outer circumferential surface 124, a rear protrusion 130, a side protrusion 160, an inner circumferential surface 170, and a packing groove 180. The rotation member 140 is rotatably coupled to one side of the outer circumferential surface 124 of the cover 120.

The cover body 122 is a part that covers the upper part of the container body 200 and thus has a crossing surface similar to the container body 200. Since the cover body 122 moves in the horizontal direction in a state where it is placed on the container body 200, the cover body is formed to be slightly larger than the inlet of the container body 200. The outer circumferential surface 124 is formed on the circumference of the cover body 122, and the inner circumferential surface 170 and the packing groove 180 are formed inside the cover body 122.

The outer circumferential surface 124 forms an outer surface of the cover 120 and extends downward with a constant length from the cover body 122. In the cover body 122 having a rectangular shape, the outer circumferential surface 124 is formed on three side surfaces thereof, and the outer circumferential surface 124 is not formed or is formed with a short length on the other side surface (part in which a circumferential groove 126 is formed). The rotation member 140 is coupled to the part in which the outer circumferential surface 124 is not formed or is formed with a short length, and the packing protrusion 272 of the packing 260 is exposed to the outside.

The cover 120 according to this embodiment has a structure in which the outer circumferential surface 124 extends downward with a constant length from three side surfaces. Accordingly, even when the cover 120 is placed with the inner surface directed to the floor, the inner circumferential surface 170 and the packing 260 in the cover 120 do not come in contact with the floor. Accordingly, even when the cover 120 is not placed upside down, the floor is not contaminated by the cover 120 nor the inner surface of the cover 120 is not contaminated by the floor.

As can be seen from FIGS. 2 and 3, the outer circumferential surface 124 has a curved cross-sectional shape. In the packing 260 located inside the outer circumferential surface 124, an inner edge 266 thereof is formed to be higher than an outer edge 264 thereof so as to correspond to the shape of the outer circumferential surface 124.

Since the inner edge 266 is higher than the outer edge 264, a larger elastic force is applied to the inner edge 266 when coupling the cover 120 to the container body 200. Since an inner protrusion 267 is formed in the lower end portion of the inner edge 266, the inner edge 266 is more greatly deformed. In this way, the contact area of the inner edge 266 having greatly deformed with the inner surface of the container body 200 increases to further enhance the sealing force. When the cover 120 is decoupled from the container body 200, the cover 120 can easily move upward by the elastic restoring force of the inner edge 266.

Since the outer circumferential surface 124 is inclined outward, the cover 120 can easily move in the horizontal direction when coupling the cover 120 to the container body 200. That is, when coupling the cover 120 to the container body 200, the inner side surface of the outer circumferential surface 124 presses down the container end portion 212 of the container body 200. At this time, since the outer circumferential surface 124 is inclined, the cover 120 can more easily move in the horizontal direction.

The outer circumferential surface 124 is located outside the container end portion 212 of the container body 200. Accordingly, even when an impact is applied to the container 100 due to a fall or the like, the movement of the cover 120 in the horizontal direction to prevent the cover 120 from being opened.

A circumferential groove 126 is formed on one side of the outer circumferential surface 124. The circumferential groove 126 corresponds to a part which is formed slightly concave in the outer circumferential surface 124. The circumferential groove 126 includes a protrusion insertion groove 128 for exposing the packing protrusion 272 of the packing 260. An air passage 129 corresponding to a passage through which air flows into the container body 200 is formed in the protrusion insertion groove 128. The cover 120 may be symmetric about the air passage 129.

In the part in which the circumferential groove 126 is formed, the rotation member 140 is rotatably coupled to the outer circumferential surface 124 as illustrated in FIG. 2. The circumferential groove 126 provides a space for allowing the pressing protrusion 148 formed in the rotation member 140 to rotate.

A pair of rear protrusions 130 is formed to protrude inside the outer circumferential surface 124. The rear protrusions 130 are formed at positions of the outer circumferential surface 124 opposite to the circumferential groove 126. The rear protrusions 130 are locked to a rotation locking portion 220 formed in the container body 200.

Each rear protrusion 130 may have an inclined surface (not illustrated). The inclined surface enables the rear protrusion 130 to be easily locked to a rotation locking protrusion 222 of the rotation locking portion 220.

The cover 120 according to this embodiment includes a pair of rear protrusions 130, but may include one or more rear protrusions. The rear protrusions 130 are coupled to the lower part of the container edge 210 of the container body 200, but may be coupled to the container edge 210 at the same height or may be coupled to the container edge 210 in the upper part thereof. That is, the container according to the invention is not limited by the height of the rear protrusions.

A pair of side protrusions 160 is formed symmetrically inside the outer circumferential surface 124. The side protrusions 160 are locked to side locking portions 230 formed in the container body 200.

An inclined surface (not illustrated) may be formed on the side surface and/or the top surface of each side protrusion 160. The inclined surface allows the side protrusion 160 to be easily locked to the corresponding side locking portion 230.

The cover 120 according to this embodiment includes total four side protrusions 160 of two side protrusions for each side surfaces. However, this configuration is exemplary and the cover 120 may include one side protrusion or three or more side protrusions for each side surface.

The side protrusions 160 are locked to the lower part of the container edge 210 of the container body 200, but may be coupled to the container edge 210 at the same height or may be coupled to the container edge 210 in the upper part thereof. That is, the container according to the invention is not limited by the height of the side protrusions 160.

The inner circumferential surface 170 protrudes downward in the inner surface of the cover body 122. The inner circumferential surface 170 is located inside the outer circumferential surface 124. A packing groove 180 into which the packing 260 is inserted is formed between the inner circumferential surface 170 and the outer circumferential surface 124.

The cover 120 of the container 100 according to this embodiment moves in the horizontal direction in the course of coupling to the container body 200. Accordingly, in order to enable movement in the horizontal direction of the cover 120, the inner circumferential surface 170 is formed to be slightly smaller than the inlet of the container body 200.

When the cover 120 is coupled to the container body 200, the inner circumferential surface 170 is located inside the container body 200. Positioning protrusions 172 are formed to protrude downward at constant intervals on the inner circumferential surface 170. The positioning protrusions 172 serves to easily position the cover 120 when placing the cover 120 on the container body 200. The positioning protrusions 172 also serves to come in contact with the inner surface of the container body 200 to prevent excessive movement of the cover 120 when the cover 120 moves in the horizontal direction.

As illustrated in FIGS. 4 and 5, the passage 174 is formed on the outer side surface of the inner circumferential surface 170 adjacent to the circumferential groove 126. The air passage 174 is located inside the container body 200 when the cover 120 is coupled to the container body 200. The air passage 174 communicates with another air passage 129. When the air passage 129 located on the outermost side is opened by the rotation of the rotation member 140, air flows into the container body 200 via the air passage 174. Accordingly, when decoupling the cover 120 from the container body 200, the vacuum pressure is released due to the opened air passages 129 and 174 and thus the cover 120 can be easily decoupled.

Figure 10:
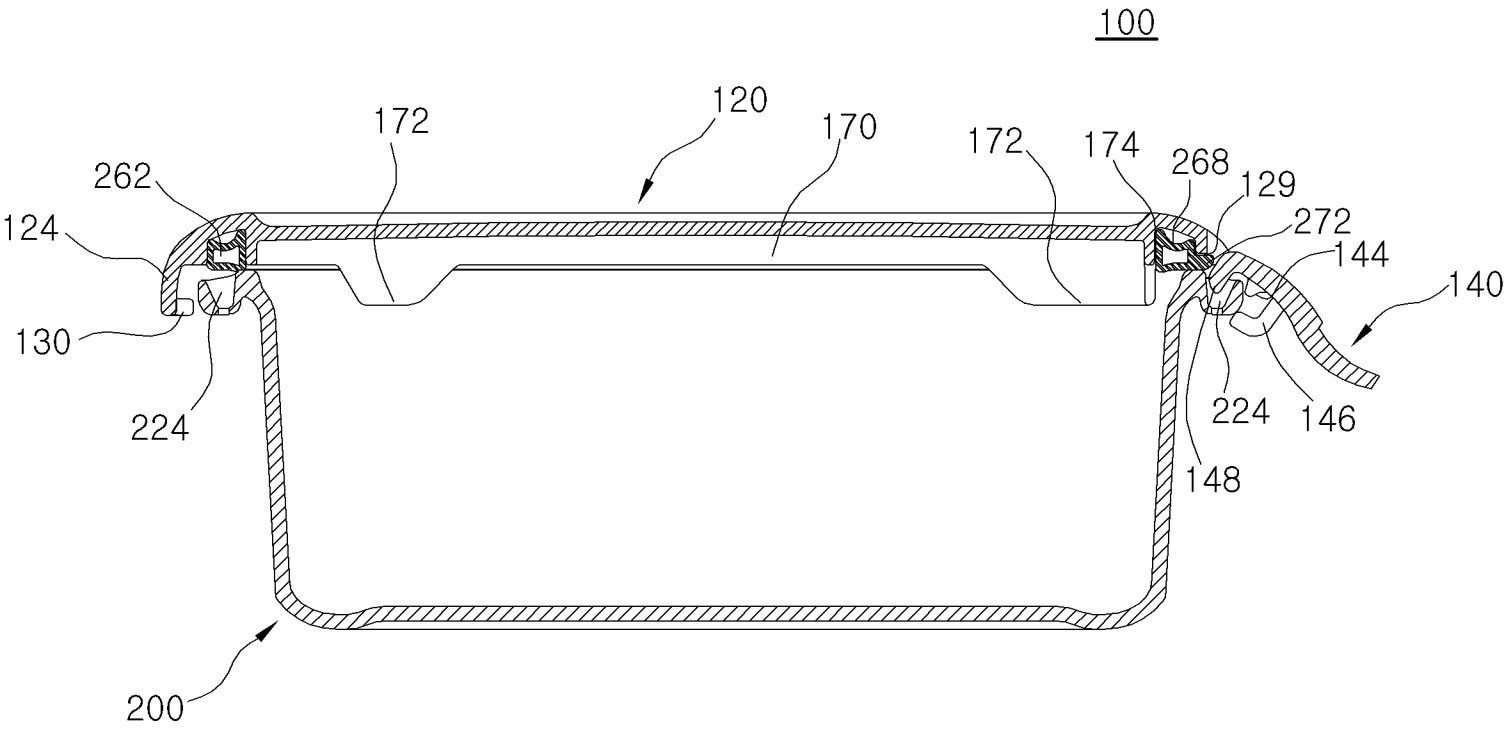
FIG. 10 is a cross-sectional view illustrating a coupling relation between the rotation member and a rotation locking portion in an initial course of coupling the cover to the container body.

The packing 260 is inserted into the packing groove 180. An air passage is formed in the packing groove 180. The bottom surface of the packing groove 180 is formed to be inclined down to the outside by the outer circumferential surface 124 having a curved shape, as illustrated in FIG. 10 and the like. To correspond to the shape of the packing groove 180, the inner edge 266 of the packing 260 is also formed to be higher than the outer edge 264. The packing 260 having an air groove 268 formed therein is attached to the bottom surface of the packing groove 180 by the vacuum pressure.

In the container 100 according to this embodiment, the air passages 129 and 174 are formed in the cover 120, but an air passage may also be formed in the packing 260 and/or the container body 200.

The rotation member 140 coupled to the cover 120 will be described below with reference to FIGS. 2 and 3 and FIGS. 5 and 6.

FIG. 5 is a perspective view illustrating the rotation member 140 of the container 100 illustrated in FIG. 2 and FIG. 6 is a side view of the rotation member 140 illustrated in FIG. 5.

Referring to FIGS. 2 and 3 and FIGS. 5 and 6, the container 100 according to this embodiment includes a single rotation member 140. The rotation member 140 is rotatably coupled to the outer circumferential surface 124 of the cover 140 so as to couple the cover 120 to the container body 200.

The rotation member 140 includes a cutout portion 141, a support protrusion 144, a rotation locking protrusion 146, and a pressing protrusion 148. The rotation member 140 can be formed symmetric about the pressing protrusion 148.

The cutout portion 141 is formed at the center of the upper part of the rotation member 140 and includes the pressing protrusion 148 therein. Connection end portions 142 connected to the outer circumferential surface 124 are located on the right and left sides of the cutout portion 141, respectively. The rotation member 140 rotates about the connection end portions 142.

The support protrusions 144 symmetrically protrude from the right and left sides of the pressing protrusion 148. When the rotation member 140 rotates and is coupled to the rotation locking portion 220 of the container body 200, the support protrusions 144 press the container edge 210 of the container body 200. When the rotation member 140 is further pulled down, the rotation member 140 rotates about the support protrusions 144 and pulls the cover 120 in the horizontal direction.

In the container 100 according to this embodiment, the cover 120 is pulled in the horizontal direction by the support protrusions 144 having a protrusion shape, but the cover 120 may be pulled in the horizontal direction by a structure in which the parts having the support protrusions 144 formed therein are formed to be thick. By locating the connection end portions 142 of the rotation member 140 to be closer to the outer circumferential surface 124, the same advantage as the support protrusions 144 can be achieved.

A pair of rotation locking protrusions 146 protrudes from the inner surface of the rotation member 140. Each rotation locking protrusion 146 has an "L" shape. The rotation locking protrusions 146 are coupled to the rotation locking protrusions 222 of the container body 200.

The single pressing protrusion 148 is formed at the center of the rotation member 140. The pressing protrusion 148 has an "L" shape and the end is inclined. When the cover 120 is coupled to the container body 200, the pressing protrusion 148 presses the packing protrusion 272 of the packing 260 upward to close the air passage 129. When the cover 120 is decoupled from the container body 200, the pressing protrusion 148 releases the upward pressing against the packing protrusion 272 to open the air passage 129. When the cover 120 is decoupled from the container body 200, the pressing protrusion 148 is locked to the pressing protrusion insertion groove 224 of the container body 200 to push up the cover 120 by the upward rotation of the rotation member 140.

The rotation member 140 of the container 100 according to this embodiment includes a pair of support protrusions 144 and a pair of rotation locking protrusions 146 which are formed symmetric. However, the arrangement and the number of the support protrusions and the rotation locking protrusions may be changed in variety.

The packing 260 of the container 100 according to this embodiment will be described below with reference to FIGS. 2 and 3 and FIG. 7.

Figure 7:
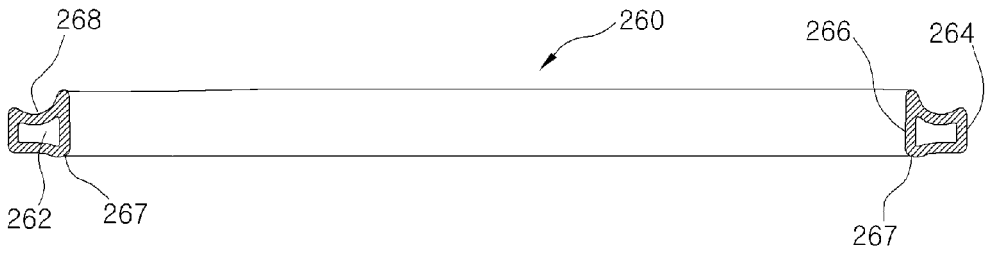
FIG. 7 is a cross-sectional view taken along line AA of a packing illustrated in FIG. 3.

FIG. 7 is a cross-sectional view taken along line AA of the packing illustrated in FIG. 3.

Referring to FIGS. 2 and 3 and FIG. 7, the packing 260 has a shape corresponding to the cover 120. When the cover 120 is coupled to the container body 200, the packing 260 is elastically deformed to provide a sealing force.

The packing 260 includes an internal space 262, an outer edge 264, an inner edge 266, an air groove 268, and a packing protrusion 272.

The internal space 262 of the packing 260 corresponds to an empty space formed in the packing 260.

The outer edge 264 forms the outer side surface of the packing 260, and the inner edge 266 forms the inner side surface of the packing 260. To correspond to the shape of the packing groove 180, the inner edge 266 is formed to be higher than the outer edge 264. The air groove 268 is formed between the inner edge 266 and the outer edge 264. The inner protrusion 267 protrudes downward from the lower end portion of the inner edge 266.

When the packing 260 is coupled to the packing groove 180, air flows into the air groove 268. When the cover 120 is coupled to the container body 200 and the packing 260 is pressed, air remaining in the air groove 268 is discharged to the outside to form a vacuum pressure. When the cover 120 is decoupled from the container body 200, it is possible to prevent the packing 260 from being decoupled from the packing groove 180 by this vacuum pressure.

The inner protrusion 267 protrudes downward from the lower end of the inner edge 266. The inner protrusion 267 serves to enhance the elastic force of the inner edge 266. When the cover 120 is coupled to the container body 200, the inner protrusion 267 is located inside the container body 200 and presses the inner surface of the container body 200. The leakage of contents (not illustrated) in the container body 200 is prevented by the inner protrusion 267 and the cover 120 can be easily decoupled by the elastic restoring force thereof.

The packing protrusion 272 protrudes outward from one side of the outer edge 264. The packing protrusion 272 is inserted into the protrusion insertion groove 128 of the cover 120 and an end thereof is exposed to the outside. When the cover 120 is coupled to the container body 200, the packing protrusion 272 is pressed upward by the pressing protrusion 148 to close the air passage 129. When the cover 120 is decoupled from the container body 200, the packing protrusion 272 is pressed downward by the pressing protrusion 148 to open the air passage 129.

The inner protrusion 267 serves to enhance the elastic force of the inner edge 266 of the packing 260. When the cover 120 is coupled to the container body 200, the inner protrusion 267 is pressed in the horizontal direction by the container body 200 to deform the packing 260. The deformed packet 260 forms an air passage between the packing groove 180 and the packing.

The inner protrusion 267 may also be formed at the lower ends of the inner edge 266 and the outer edge 264.

The container body 200 of the container 100 according to this embodiment will be described below with reference to FIGS. 2 and 3 and FIGS. 8 and 9.

Figure 8:
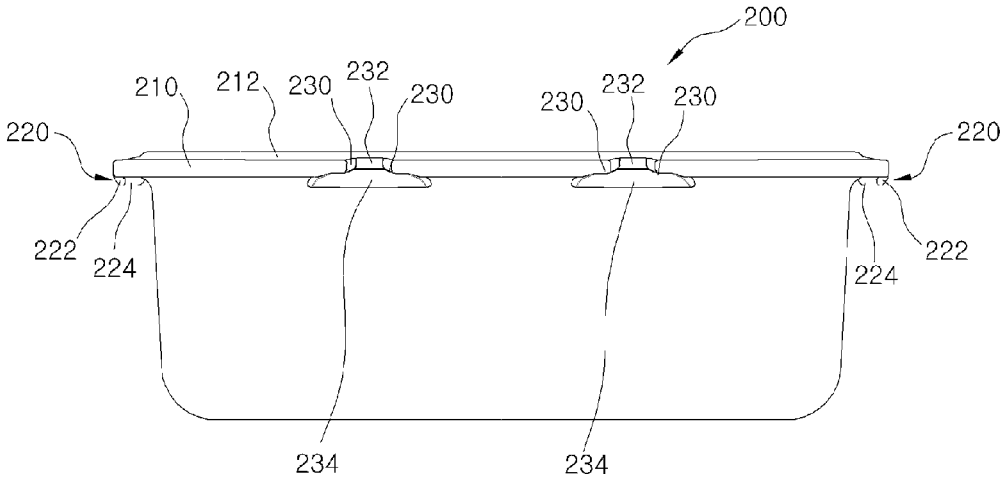
FIG. 8 is a front view of a container body illustrated in FIG. 2.
Figure 9:
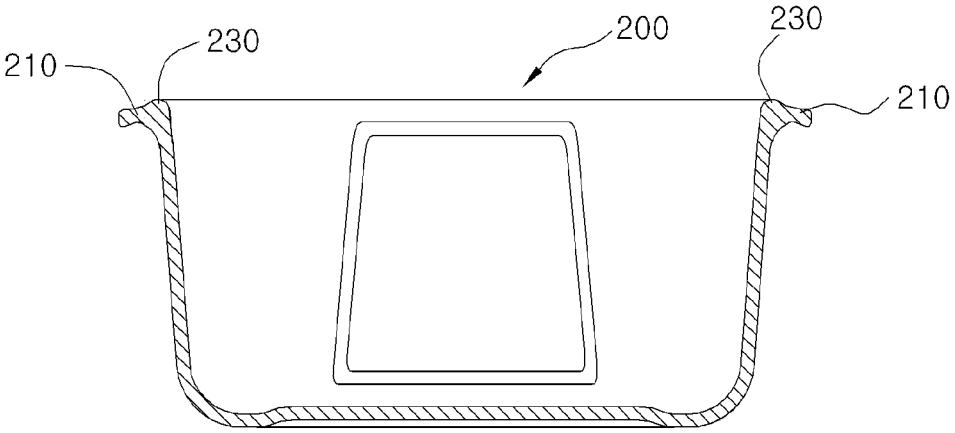
FIG. 9 is a cross-sectional view taken along line BB of the container body illustrated in FIG. 3.

FIG. 8 is a front view illustrating the container body 200 of the container 100 illustrated in FIG. 3 and FIG. 9 is a cross-sectional view taken along line BB of the container body 200 illustrated in FIG. 3.

Referring to FIGS. 2 and 3 and FIGS. 8 and 9, the container body 200 has an empty space having a constant volume and receiving contents (not illustrated) therein. The container body 200 is formed symmetric in the horizontal direction and the vertical direction. Therefore, even when the rotation member 140 of the cover 120 is located on any side in the horizontal direction of the container body 200 illustrated in FIG. 8, the cover 120 can be coupled to the container body.

The container body 200 includes a container edge 210, a side locking portion 230, and a rotation locking portion 220.

The container edge 210 protrudes outward along the circumference of the container body 200. The rotation locking portion 220 coupled to the rotation member 140 or the rear protrusions 130 and the side locking protrusions 230 coupled to the side protrusions 160 are formed in the container edge 210. The container end portion 212 protrudes upward from the container edge 210.

When the cover 120 is coupled to the container body 200, the container end portion 212 is pressed by the packing 260. Referring to FIG. 9, the container end portion 212 has a curved cross-sectional shape. Accordingly, the pressed packing 260 comes in close contact with the container end portion 212, thereby enhancing the sealing force of the packing 260.

The side locking portions 230 are formed symmetric for each side surface of the container body 200. The side locking portion 230 is a part to which the corresponding side protrusion 160 of the cover 120 is locked in the container edge 210. The bottom of the side locking portion 230 is formed concave to easily lock the slide protrusion 160 thereto. The inlet of the side locking portion 230 is inclined so as to easily insert the side protrusion 160 thereinto.

One or three or more side locking protrusions 230 may be formed on each side surface of the container body 200. In case of a circular container, the side locking portions 230 may be formed at arbitrary positions of the container body.

Each side locking groove 232 has a shape formed by cutting out a part of the container edge 210. When the cover 120 is placed on the container body 200, the side protrusion 160 passes through the side locking groove 232 and is then located at a height equal to or lower than the container edge 210. When the cover 120 is decoupled from the container body 200, the side protrusion 160 passes through the side locking groove 232 and is then decoupled from the container edge 210.

The movement cutout 234 is formed below the side locking groove 232 and has a shape formed by slightly recessing a part of the side surface of the container body 200. The movement cutout 234 allows the side protrusion 160 located below the side locking protrusion 230 to easily move.

The rotation locking portion 220 is formed symmetric on the opposite side surfaces of the container body 200. The rotation locking protrusions 146 of the rotation member 140 are locked to the rotation locking portions 220. The rotation locking portion 220 includes a rotation locking protrusion 222 and a pressing protrusion insertion groove 224.

The rotation locking protrusion 222 protrudes downward from the bottom surface of the container edge 210 and has a constant length in the horizontal direction. The rotation locking protrusions 146 of the rotation member 140 or the rear protrusions 130 are locked to the rotation locking protrusions 222.

The pressing protrusion insertion groove 224 is formed inside the rotation locking protrusion 222. The pressing protrusion insertion groove 224 corresponds to a groove formed with a constant depth in the container edge 210. The tip of the pressing protrusion 148 of the rotation member 140 is inserted into the pressing protrusion insertion groove 224. Accordingly, it is possible to prevent the pressing protrusion 148 from being locked to the container edge 210 and limiting the rotation of the rotation member 140. When the rotation member 140 is pushed up to decouple the cover 120 from the container body 200, the pressing protrusion 148 is locked to the pressing protrusion insertion groove 224 and serves to push up the cover 120.

The pressing protrusion insertion groove 224 may be formed by a protrusion as well as a groove. The pressing protrusion insertion groove 224 may be disposed in various forms. For example, when the container 100 has a circular shape, plural pressing protrusion insertion grooves may be disposed at constant intervals.

A hole (not illustrated) is formed at the center of the bottom surface of the pressing protrusion insertion groove 224. The hole serves to discharge foreign materials flowing in the pressing protrusion insertion groove 224.

The container body 200 of the container 100 according to this embodiment includes the rotation locking protrusions 222 protruding downward. However, a groove shape as well as a protrusion shape may be employed as the structure that can be coupled to the rotation locking protrusions 146 of the rotation member 140.

The side surface of the container body 200 may be formed to be slightly concave. The part formed concave in this way reinforces the strength of the container body 200. The part formed concave on the side surface of the container body 200 can secure a space between contents (not illustrated) and the inner side surface of the container body 200 to facilitate circulation of air and to easily discharge a liquid in the container body 200.

The process of coupling the cover 120 of the container 100 according to this embodiment to the container body 200 will be described below with reference to FIGS. 10 to 18.

FIGS. 10, 12, 14, and 16 are diagrams sequentially illustrating the process of coupling the cover 120 to the container body 200 and are cross-sectional views illustrating the coupling relation between the rotation member 140 and the rotation locking portion 220. FIGS. 11, 13, 15, and 17 are diagrams sequentially illustrating the process of coupling the cover 120 to the container body 200, correspond to FIGS. 10, 12, 14, and 16, respectively, and are cross-sectional views illustrating the coupling relation between the side protrusions 160 and the side locking portions 230.

Figure 11:
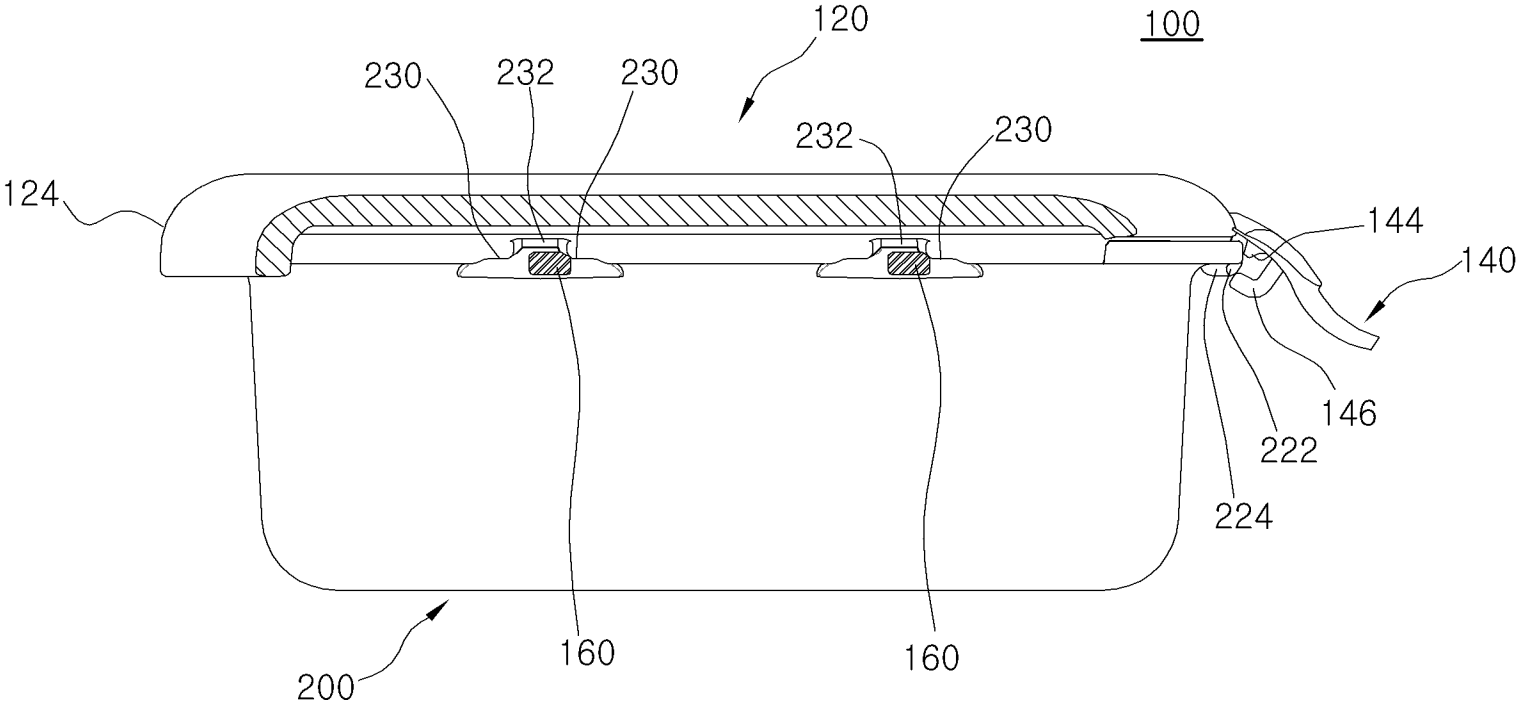
FIG. 11 is a cross-sectional view illustrating a coupling relation between a side protrusion and a side locking portion in the coupled state illustrated FIG. 10.

FIGS. 10 and 11 are cross-sectional views illustrating an initial state of the coupling of the cover 120 to the container body 200.

Referring to FIG. 10, in order to couple the cover 120 to the container body 200, the cover 120 is first placed on the container body 200. At this time, the inner circumferential surface 170 and the positioning protrusions 172 of the cover 120 are located inside the container end portion 212 and position the cover 120. The support protrusions 144 of the rotation member 140 come in contact with the container edge 210, the tip of the pressing protrusion 148 is located inside the pressing protrusion insertion groove 224, and the rotation locking protrusions 146 are not locked to the rotation locking protrusion 222. The rear protrusions 130 are also not locked to the rotation locking protrusion 222.

Referring to FIG. 11, the side protrusions 160 in the state illustrated in FIG. 10 passes through the side locking grooves 232 and are then located lower than the container edge 210. At this time, the side protrusions 160 are not locked to the side locking portions 230.

Figure 12:
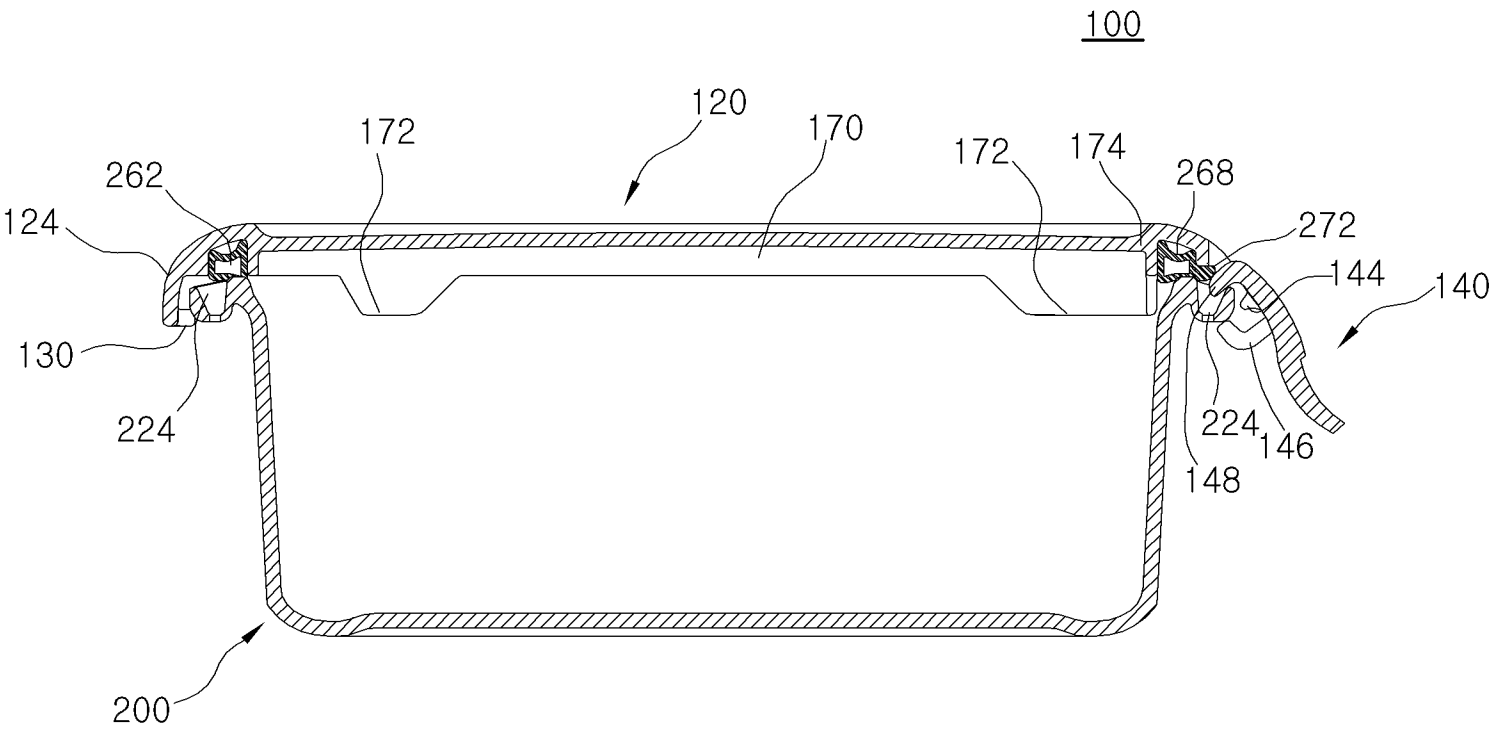
FIG. 12 is a cross-sectional view illustrating a coupling relation between the rotation member and the rotation locking portion in a state where the cover moves downward from the state illustrated in FIG. 10.
Figure 13:
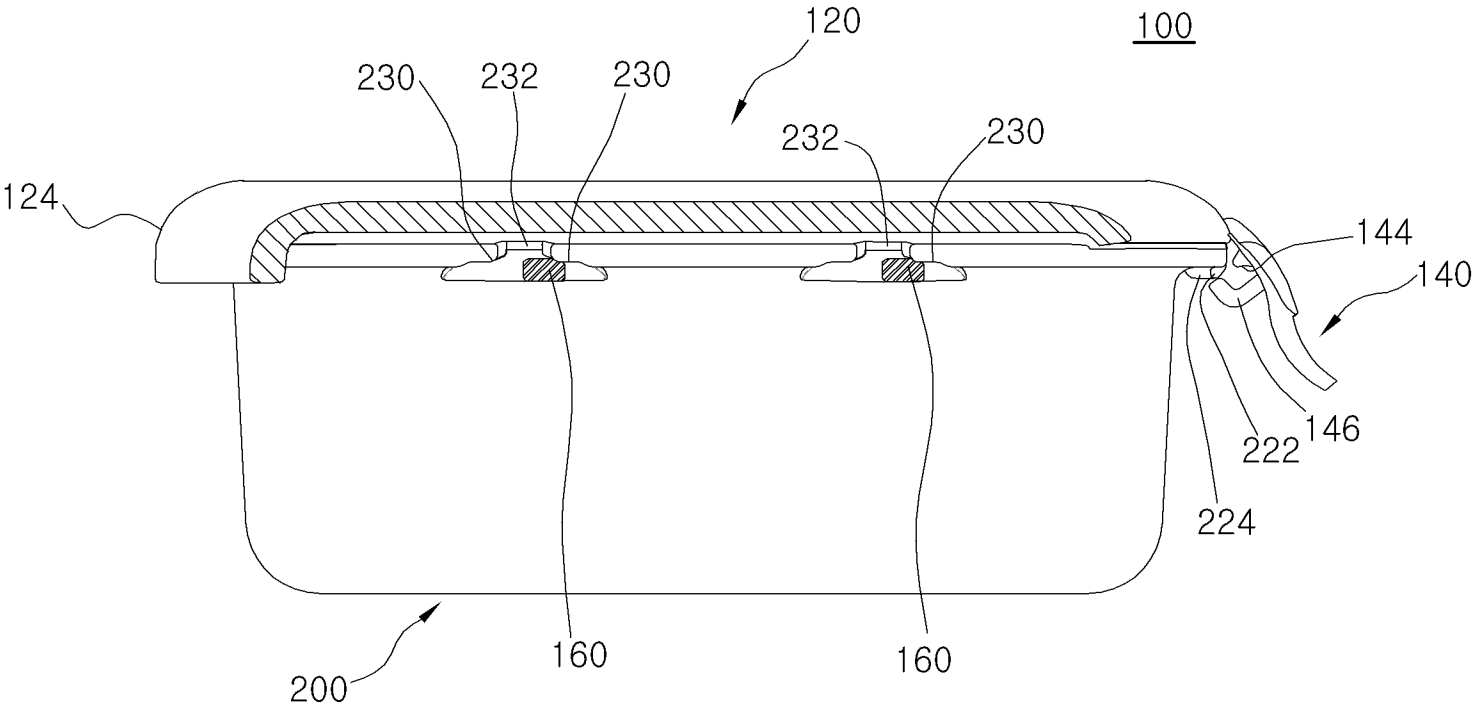
FIG. 13 is a cross-sectional view illustrating a coupling relation between the side protrusion and the side locking portion in the state illustrated FIG. 12.

When the rotation member 140 is pressed downward (rotates in the clockwise direction) in the state illustrated in FIGS. 10 and 11, the cover 120 moves from left to the right and the lower side into the state illustrated in FIGS. 12 and 13.

FIGS. 12 and 13 are cross-sectional views illustrating an intermediate state of coupling the cover 120 to the container body 200.

When the rotation member 140 is pressed downward in the state illustrated in FIGS. 10 and 11, the support protrusions 144 press the container edge 210. Accordingly, the rotation member 140 rotates about the support protrusions 144 to cause the cover 120 to move to the lateral side (to the right side in FIGS. 10 and 11) and to the lower side into the state illustrated in FIGS. 12 and 13.

By this movement of the cover 120 to the lateral side and the lower side, the side protrusions 160 move to the lateral side and the lower side and are locked to the side locking portions 230, as illustrated in FIG. 13.

Referring to FIG. 12, the rotation locking protrusion 146 of the rotation member 140 comes in contact with the rotation locking protrusion 222 in an initial coupling stage. Similarly, the rear protrusions 130 also come in contact with the rotation locking protrusion 222 in the initial coupling stage. The pressing protrusion 148 comes in contact with the packing protrusion 272 of the packing 260 with the rotation of the rotation member 140.

Figure 14:
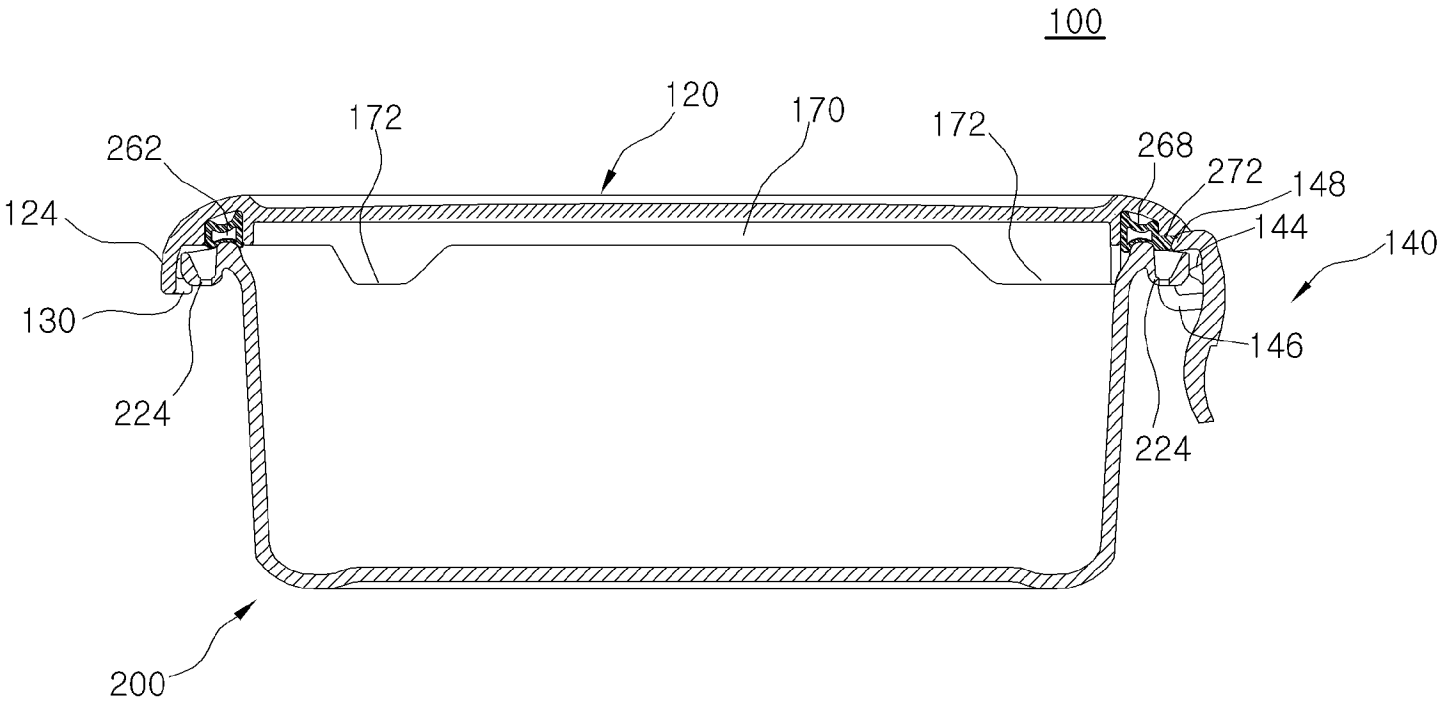
FIG. 14 is a cross-sectional view illustrating a coupling relation between the rotation member and the rotation locking portion in a state where the cover further moves downward from the state illustrated in FIG. 12.
Figure 15:
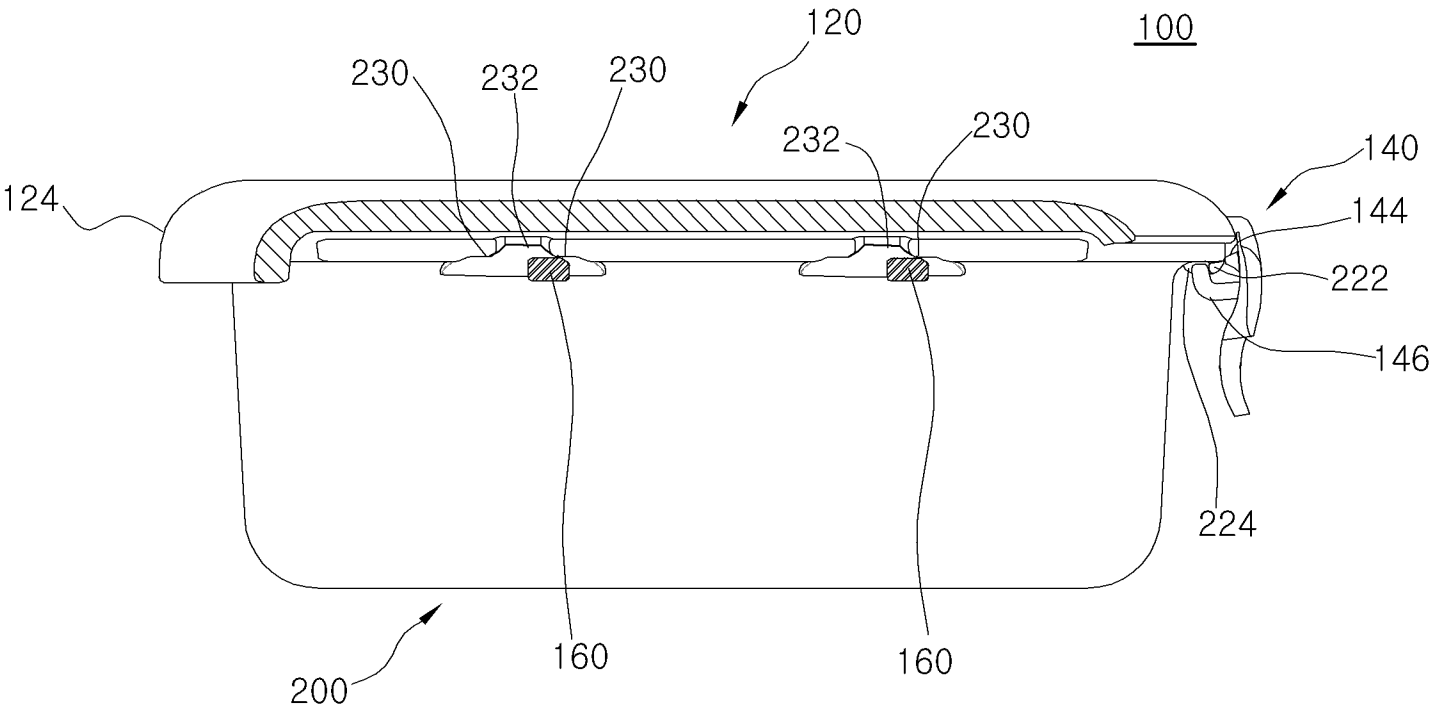
FIG. 15 is a cross-sectional view illustrating a coupling relation between the side protrusion and the side locking portion in the state illustrated FIG. 14.

When the rotation member 140 is further pull down in the state illustrated in FIGS. 12 to 13, the state illustrated in FIGS. 14 to 15 is achieved.

FIGS. 14 and 15 are cross-sectional views illustrating a state where the cover 120 is further coupled to the container body 200 from the state illustrated in FIGS. 12 and 13.

Referring to FIGS. 14 and 15, when the rotation member 140 is further pulled down, the cover 120 moves to the lateral side and the lower side. Accordingly, the rear protrusions 130 are coupled to the rotation locking protrusion 222 and the side protrusions 160 are locked to the bottom of the side locking portions 230. The rotation locking protrusions 146 are almost locked to the rotation locking protrusion 222 and the pressing protrusion 148 presses the packing protrusion 272 upward.

Figure 16:
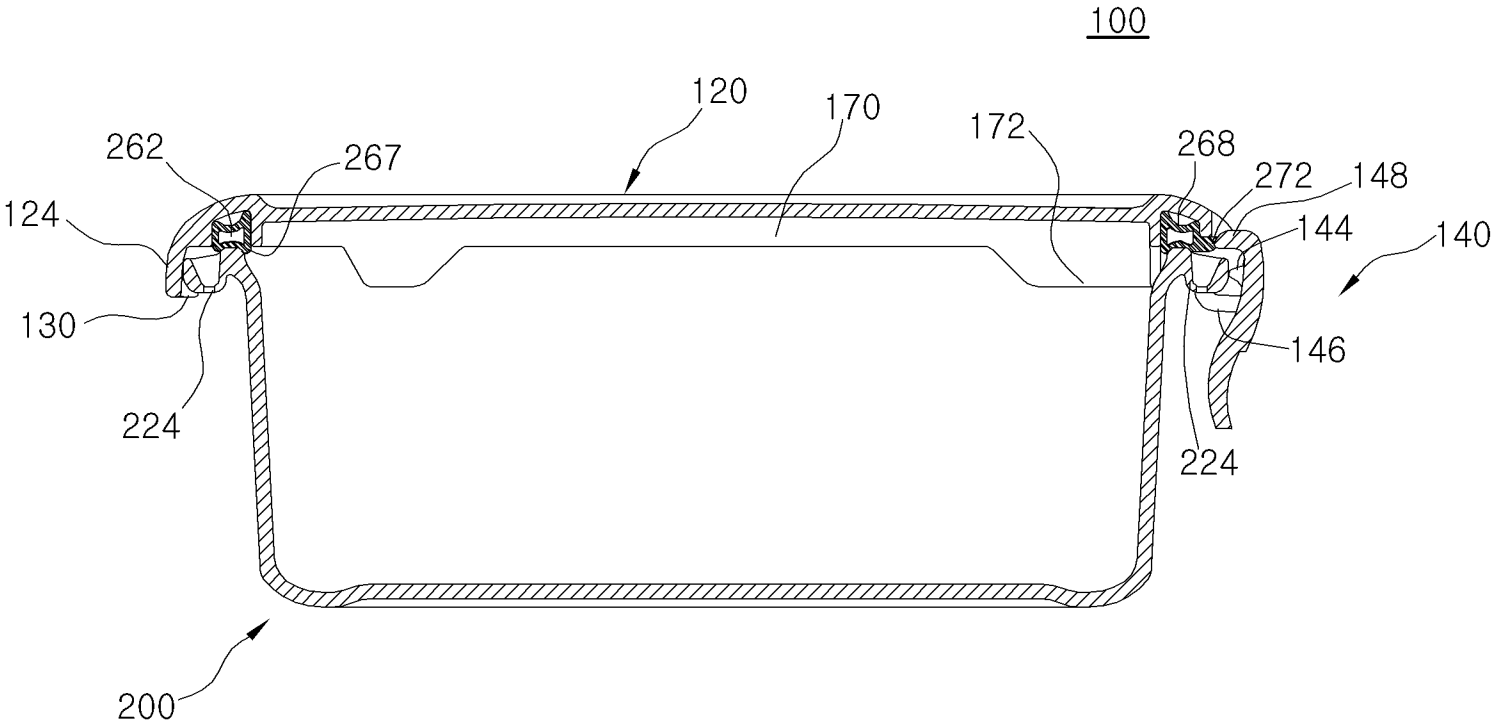
FIG. 16 is a cross-sectional view illustrating a coupling relation between the rotation member and the rotation locking portion in a state where the cover further moves downward from the state illustrated in FIG. 14 and is completely coupled to the container.
Figure 17:
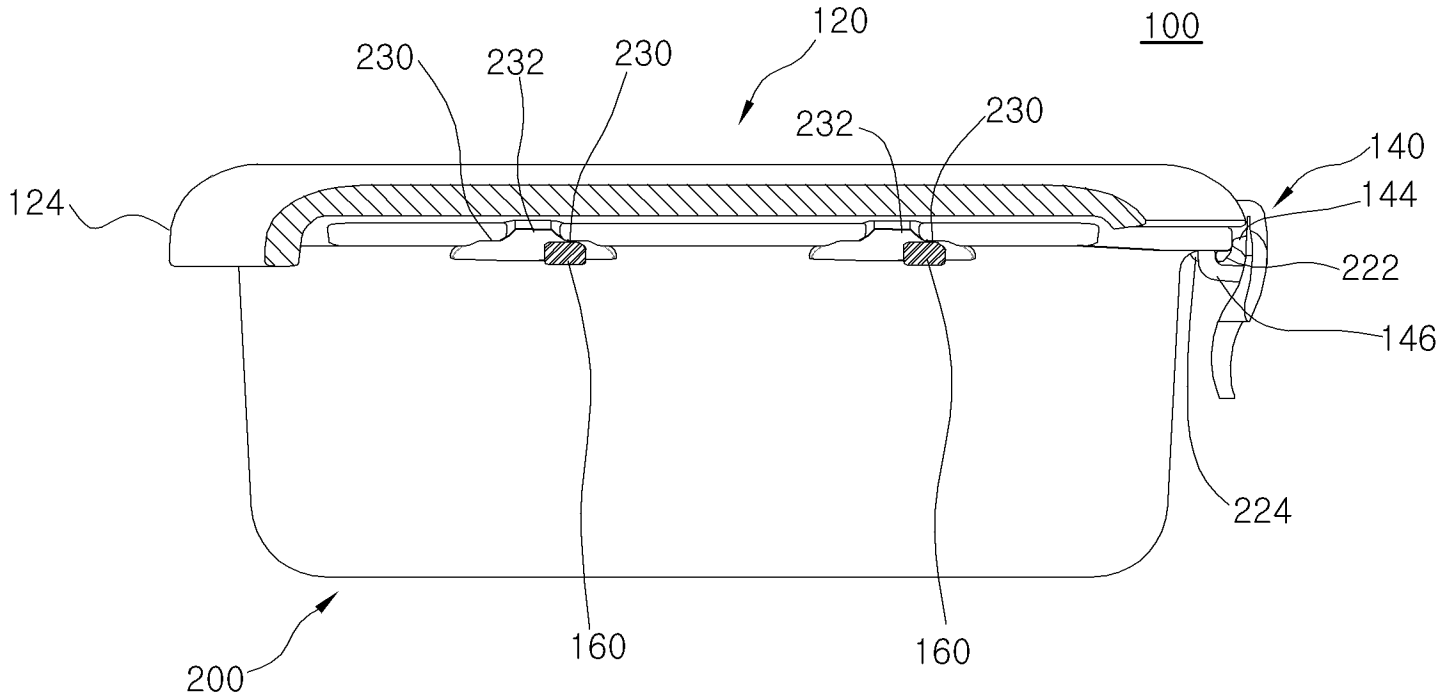
FIG. 17 is a cross-sectional view illustrating a coupling relation between the side protrusion and the side locking portion in the state illustrated FIG. 16.
Figure 18:
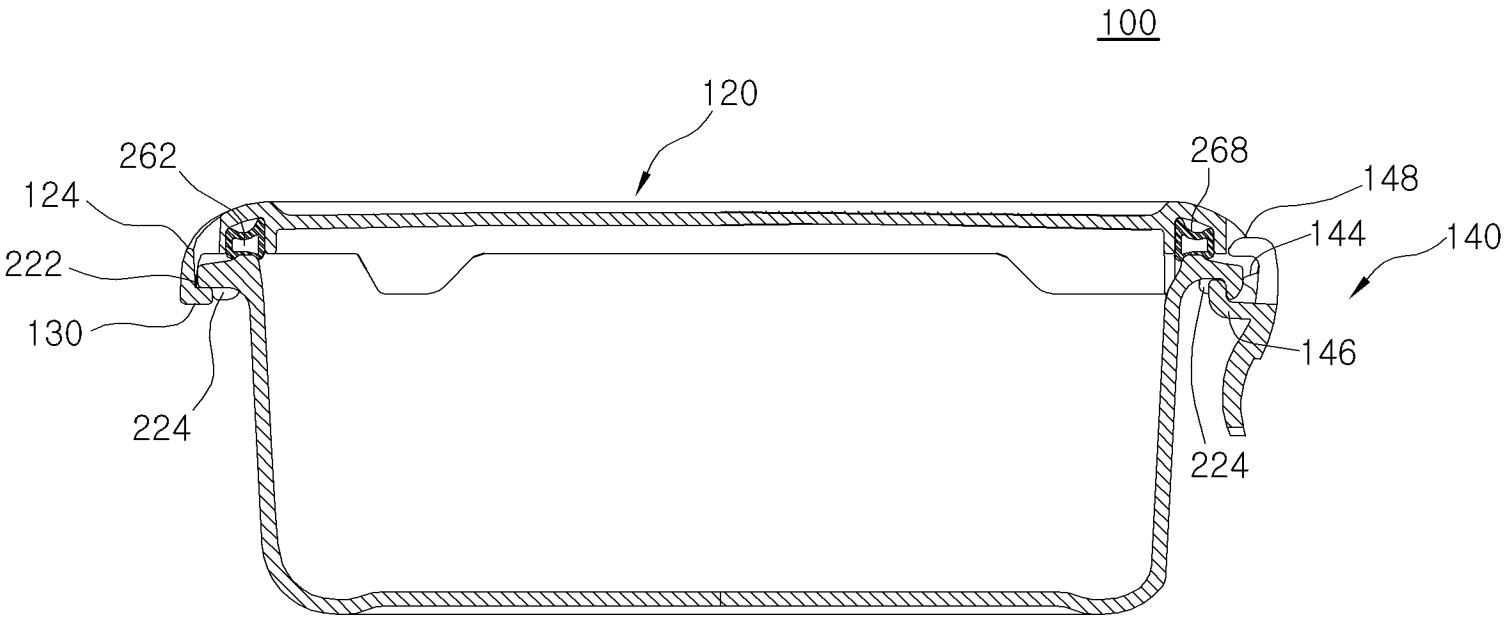
FIG. 18 is a cross-sectional view illustrating a coupling relation between a rear protrusion and the rotation locking portion in the state illustrated FIG. 16.

When the rotation member 140 is fully pulled down and the cover 120 is completely coupled to the container body 200, the state illustrated in FIGS. 16 to 18 is achieved.

FIGS. 16 to 18 are cross-sectional views illustrating a state where the cover 120 is completely coupled to the container body 200. FIG. 18 is a cross-sectional view illustrating the coupling relation between the rear protrusions 130 and the rotation locking portion 220 in the state illustrated in FIGS. 16 and 17.

Referring to FIGS. 16 to 18, when the cover 120 is completely coupled to the container body 200, the rotation locking protrusions 146 of the cover 120 are coupled to the rotation locking protrusion 222 and the rear protrusions 130 of the cover 120 are also coupled to the rotation locking protrusion 222. Accordingly, one side (the right part in FIG. 16) and the other side (the left part in FIG. 16) of the cover 120 are both coupled. The side protrusions 160 of the cover 120 are locked to the side locking portions 230. Accordingly, the cover 120 presses the container body 200 downward and contracts the packing 260 to apply the sealing force.

The packing 260 contracted by the cover 120 comes in close contact with the container end portion 212 of the container edge 210 to provide a strong sealing force. Referring to FIG. 16, the inner protrusion 267 of the packing 260 is located inside the container end portion 212. The packing protrusion 272 of the packing 260 is pressed upward by the pressing protrusion 148 to close the air passage 129. When the air passage 129 is closed, the flow of air into the container body 200 is intercepted.

In this way, the container 100 according to this embodiment can be coupled using only one rotation member 140 and thus has a merit of easy coupling. The container 100 including the single rotation member 140 has a simple structure and thus has a merit of easy washing.

In the container 100 according to this embodiment, the cover 12*o* is coupled to the container body 200 by the rotation member 140, the rear protrusions 130, and the side protrusions 160 formed symmetric. Accordingly, although the cover 120 of the container 100 according to this embodiment includes only one rotation member 140, the cover 120 can be strongly coupled to the container body 200.

Since the packing 260 including the inner protrusion 267 comes in strong and close contact with the container end portion 212 of the container body 200, the packing 260 can provide a strong sealing force.

The process of decoupling the cover 120 from the container body 200 is a reverse process of the process of coupling the cover 120. That is, when the rotation member 140 is pulled up, the cover 120 is decoupled from the container body 200 while the coupling state is sequentially changed from the state illustrated in FIGS. 16 to 18 to the state illustrated in FIGS. 10 and 11 via the state illustrated in FIGS. 14 and 15 and the state illustrated in FIGS. 12 and 13.

When the rotation member 140 is pulled up in the state illustrated in FIGS. 16 to 18, the rotation locking protrusions 146 of the rotation member 140 starts decoupling from the rotation locking protrusion 222.

By pulling up the rotation member 140, the pressing protrusion 148 releases the pressing against the packing protrusion 272 of the packing 260. Accordingly, the air passage 129 is opened and air flows into the container body 200. The air flowing into the container body 200 releases the vacuum pressure to facilitate the decoupling of the cover 120.

On the other hand, in the state illustrated in FIGS. 16 to 18, the packing 260 is in close contact with the packing groove 180 by the vacuum pressure based on the air groove 268. Accordingly, in the initial stage of opening the cover 120, the packing 260 is not easily decoupled from the packing groove 180 due to the vacuum pressure based on the air groove 268.

By pulling up the rotation member 140, the container 100 is changed to the state illustrated in FIGS. 14 and 15.

When the rotation member 140 is further pulled up in the state illustrated in FIGS. 14 and 15, the pressing protrusion 148 presses the inside of the pressing protrusion insertion groove 224 and applies a force for pushing up the cover 120. The cover 120 moves to the lateral side (to the left side in FIGS. 14 and 15) and to the upper side by the pushing-up force of the cover 120 from the pressing protrusion 148.

With the further pushing-up of the rotation member 140, the rotation locking protrusions 146 are completely decoupled from the rotation locking protrusion 222 into the state illustrated in FIGS. 10 and 11. At this time, the cover 120 completely moves to the lateral side (to the left side in FIGS. 10 and 11) and to the upper side into the initial state. In the initial state illustrated in FIGS. 10 and 11, the rear protrusions 130 are unlocked from the rotation locking protrusion 222 and the side protrusions 160 are also unlocked from the side locking portions 230.

In this way, in the container 100 according to this embodiment, since only one rotation member 140 has to be pushed up, the cover 120 can be easily decoupled from the container body 200. Particularly, since the pressing protrusion 148 is locked to the pressing protrusion insertion groove 224 to cause the cover 120 to move to the lateral side and to the upper side in the course of pushing up the rotation member 140, it is possible to more easily decouple the cover 120.

In the container 100 according to this embodiment, since the air passages 129 and 174 are opened by the pushing-up of the rotation member 140, the problem that the cover 120 cannot be easily decoupled due to the vacuum pressure can be solved. In the container 100 according to this embodiment, since the packing 260 is brought into close contact with the packing groove 180 by the air groove 268 formed in the packing 260, it is possible to prevent the packing 260 from being easily decoupled from the packing groove 180.

A cover 320 and a packing 340 of a container according to another embodiment of the invention will be described below with reference to FIGS. 19 and 20.

Figure 19:
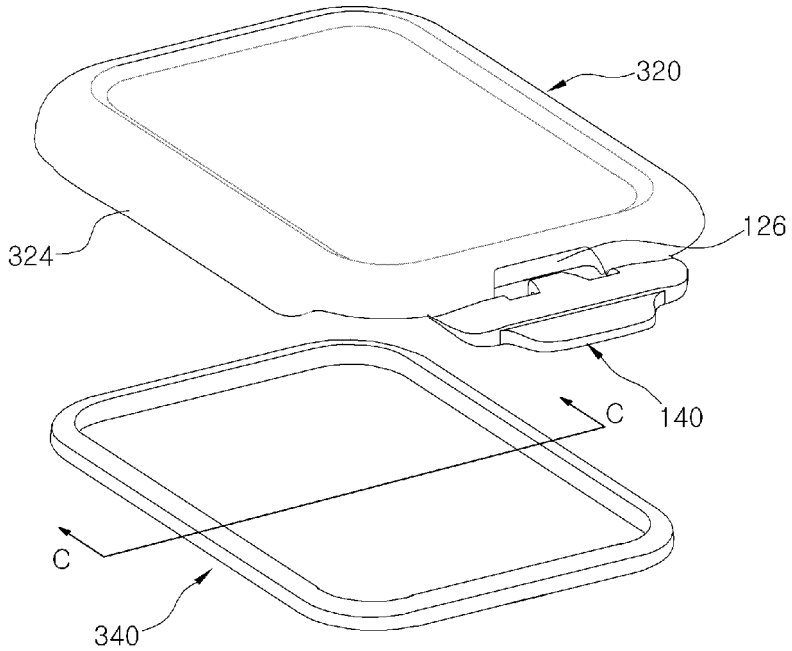
FIG. 19 is an exploded perspective view illustrating a cover and a packing of a container according to another embodiment of the invention.
Figure 20:
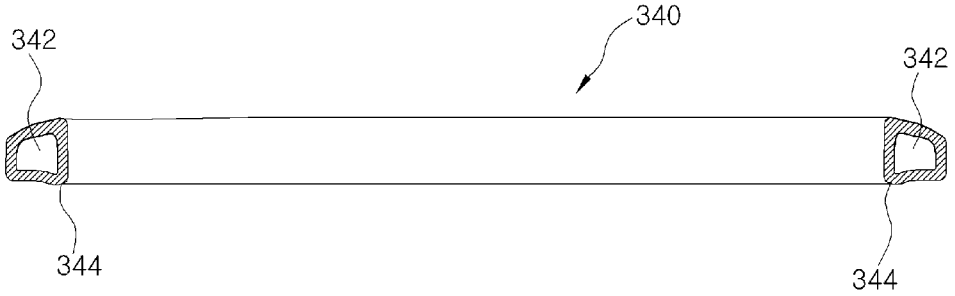
FIG. 20 is a cross-sectional view taken along line CC of the packing illustrated in FIG. 19

FIG. 19 is an exploded perspective view illustrating a cover and a packing of a container according to another embodiment of the invention and FIG. 20 is a cross-sectional view taken along line CC of the packing illustrated in FIG. 19.

Referring to FIGS. 19 and 20, the container according to this embodiment has a configuration similar to the container 100 illustrated in FIGS. 2 to 18, but is different therefrom in structured of the cover 320 and the packing 340. Accordingly, the container according to this embodiment employs the container body 200 illustrated in FIGS. 9 and 10.

The cover 320 has almost the same configuration as the cover 120 of the container 100 according to the above-mentioned embodiment, but is different therefrom in that the configuration corresponding to the protrusion insertion groove 128 is not formed in the outer circumferential surface 324. Accordingly, the protrusion insertion groove 128 is not formed in the circumferential groove 326 formed in the outer circumferential surface 324. An air passage is not formed in the cover 320.

To correspond to this outer circumferential surface 324, the packing 340 according to this embodiment does not include a packing protrusion. The packing 340 according to this embodiment does not include an air groove. Accordingly, the cross-section of the packing 340 has a trapezoidal shape and an internal space 342 corresponding to an empty space is formed therein. A packing protrusion 344 protruding downward is formed inside the packing 340.

In the course of coupling and decoupling the cover 320 according to this embodiment to and from the container body, the pressing protrusion 148 of the rotation member 140 does not close or open the air passage as described above by pressing the packing 340. However, the cover 120 can be easily decoupled by the pushing-up of the pressing protrusion 148 of the rotation member 140 rotatably coupled to the cover 320.

In this way, the container according to the invention may have a packing various configurations. For example, the packing 340 illustrated in FIGS. 19 and 20 may have the packing protrusion 272 on the side surface thereof. Accordingly, the cover may employ the cover 120 illustrated in FIG. 4.

The packing 260 illustrated in FIG. 7 or the like may not include the packing protrusion 272. Accordingly, the cover may employ the cover 320 illustrated in FIG. 19.

While the invention is described above with reference to the embodiment, it will be understood by those skilled in the art that the invention can be modified and changed in various forms without departing from the spirit and scope of the invention described in the appended claims.

The invention claimed is:

1. A container comprising:

a cover;

a container body, the container body having a sidewall, wherein a rotation member is disposed on one side of the cover so as to be rotatable, the rotation member extending along the sidewall;

a first rotation locking portion on an upper portion of the sidewall; and a second rotation locking portion on the upper portion of the sidewall, the second rotation locking portion being formed symmetric opposite the first rotation locking portion, wherein the cover is pulled down to seal the container body by bringing an inner surface of the rotation member into contact with the first rotation locking portion to move the cover to the side on which the rotation member is located in the course of coupling the rotation member to the side surface of the container body, wherein the cover has a slide locking member adjacent to the rotation member, the slide locking member engaging the container body only when the rotation member is rotated.

2. The container according to claim 1, wherein the slide locking member includes a rear protrusion, and wherein the rear protrusion is coupled to or decoupled from the container body by rotation of the rotation member.

3. The container according to claim 1, wherein the slide locking member includes a side protrusion, and wherein the side protrusion is coupled to or decoupled from the container body by rotation of the rotation member.

4. The container according to claim 1, further comprising a packing that is coupled to the cover, wherein an air passage is formed in any one of the cover and the container body, and wherein the packing is pressed or the pressing is released by the rotation of the rotation member to close or open the air passage.

5. The container according to claim 1, wherein a support protrusion for contact with the side surface protrudes inward from the inner surface of the rotation member.

6. The container according to claim 1, wherein the slide locking member includes a rear protrusion on a side opposite to the side on which the rotation member is located, and wherein the rear protrusion has an inclined surface and comes in contact with the side surface of the container body to push down the cover when the cover moves in a side direction.

7. The container according to claim 1, wherein the slide locking member includes a side protrusion, and wherein the side protrusion has an inclined surface and comes in contact with the side surface of the container body to push down the cover when the cover moves in a side direction.

8. A container comprising:

a cover; and a container body, the container body having a sidewall, wherein a rotation member is disposed on one side of the cover so as to be rotatable, the rotation member releasably coupled to an exterior surface of sidewall of the container sidewall, wherein the cover is decoupled from the container body by locking a pressing protrusion of the rotation member to a side surface of the container body to move the cover to a side opposite to the side on which the rotation member is located in the course of decoupling the rotation member from the side surface of the container body, and wherein the cover has a slide locking member, the slide locking member disengaging the container body when the rotation member is rotated.

9. The container according to claim 8, wherein a pressing protrusion insertion groove or protrusion to which the pressing protrusion is locked is formed on the side surface of the container body.

10. The container according to claim 8, wherein the pressing protrusion presses on an upper side of the side surface to create an upwardly directed camming force on the cover.

11. The container according to claim 8, wherein the slide locking member includes a rear protrusion, and wherein the rear protrusion is coupled to or decoupled from the container body by rotation of the rotation member.

12. The container according to claim 8, wherein the slide locking member includes a side protrusion, and wherein the side protrusion is coupled to or decoupled from the container body by rotation of the rotation member.

13. The container according to claim 8, further comprising a packing that is coupled to the cover, wherein an air passage is formed in any one of the cover and the container body, and wherein the packing is pressed or the pressing is released by the rotation of the rotation member to close or open the air passage.

14. A container, comprising:

a container body having a bottom wall and a sidewall;

a cover; and a rotation member rotatably connected to the cover, the rotation member comprising:

a main body;

a pressing protrusion extending from the main body in a first direction and engaging a top edge of the container body sidewall; and a locking protrusion extending from the main body in the first direction, the locking protrusion engaging the container body below the top edge of the container body sidewall, further comprising a support protrusion extending from the main body in the first direction, the support protrusion being between the pressing protrusion and the locking protrusion.

15. The container of claim 14, further comprising a groove formed in the top edge of the container body, the pressing protrusion engaging the groove.

16. The container of claim 14, further comprising a container locking protrusion extending from the container sidewall, the locking protrusion engaging a lower surface of the container locking protrusion.

* * * * *